United States Patent [19]

Fieberg et al.

[11] 4,414,736

[45] Nov. 15, 1983

[54] INSERTION AND EXTRACTION TOOL FOR CONNECTOR TERMINALS

[75] Inventors: Russell F. Fieberg, Westminster; Donald E. Fieberg, Sunset Beach, both of Calif.

[73] Assignee: Russtech Engineering Company, Inc., Huntington Beach, Calif.

[21] Appl. No.: 324,155

[22] Filed: Nov. 23, 1981

[51] Int. Cl.[3] ..... H01R 43/00

[52] U.S. Cl. ..... 29/747; 29/758; 29/764; 294/103 R

[58] Field of Search ..... 29/747, 739, 758, 764; 81/355, 423, DIG. 6; 294/103

[56] References Cited

U.S. PATENT DOCUMENTS 3,538,585 11/1970 Hendry et al. ..... 29/764

4,268,955 5/1981 Daniels ..... 29/747

*Primary Examiner*—Carl E. Hall

*Attorney, Agent, or Firm*—I. Michael Bak-Boychuk

[57] ABSTRACT

A contact insertion and extraction tool for use with multi-pin connectors is provided with an elongate handle having one fixed extension to which a first semi-circular tubular segment is attached and a sliding extension attached to a second semi-circular segment which, when articulated, opposes the longitudinal edges of the first tubular segment. When the segments are abutted against each other a cylindrical, hollow guide is formed which may grasp the lateral surfaces of a lead for insertion or extraction into the insulator block of the connector.

1 Claim, 8 Drawing Figures

FIG. 1
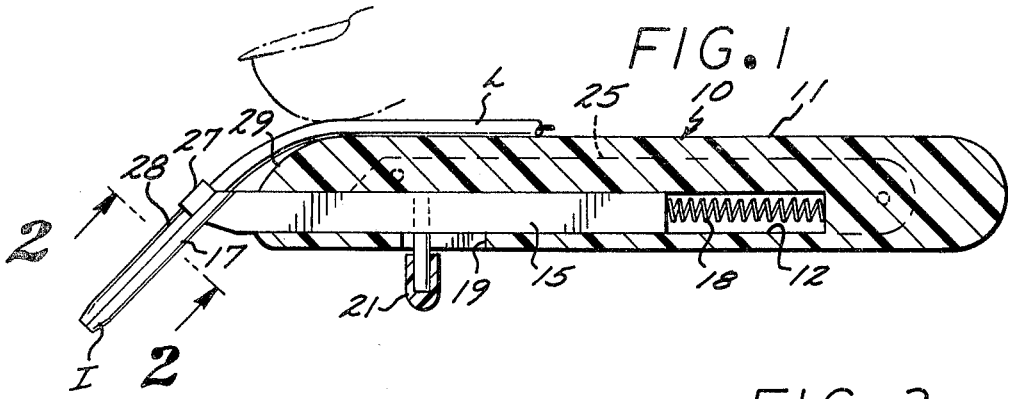
FIG. 2
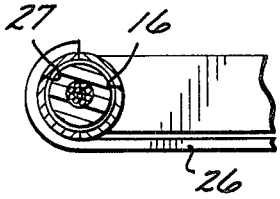
FIG. 3
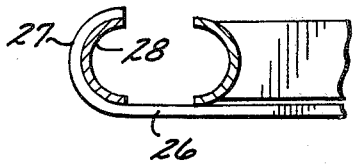
FIG. 4
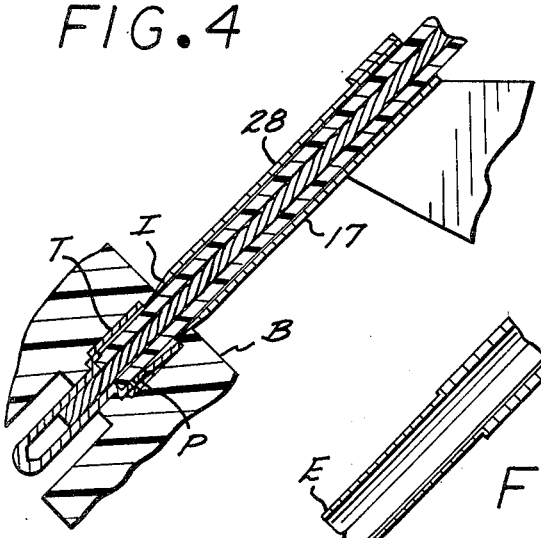
FIG. 5
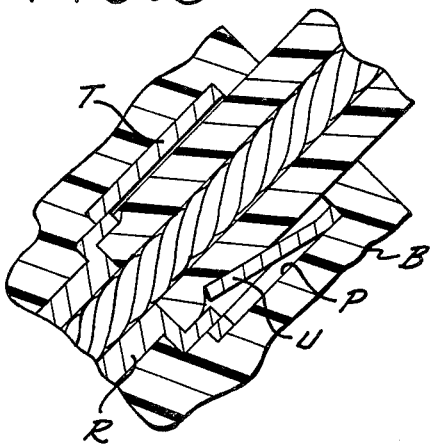
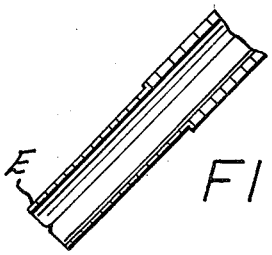
FIG. 6
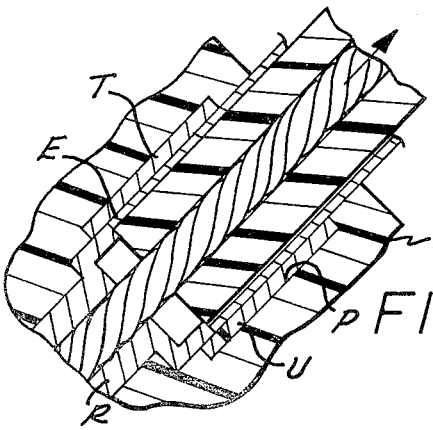
FIG. 7
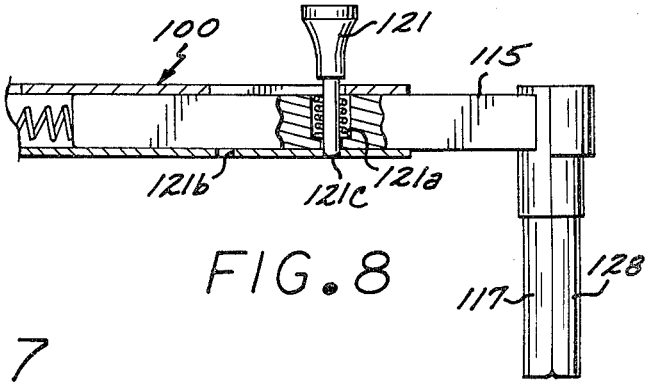
FIG. 8

INSERTION AND EXTRACTION TOOL FOR CONNECTOR TERMINALS

BACKGROUND OF THE INVENTION

1. Field of the Invention

The present invention relates to installation tools, and more particularly to tools for installing end terminals into a connector.

2. Description of the Prior Art

In various electrical and electronic applications the use of multi-pin connectors is frequently practiced. Typically such connectors are of the rear insertion and rear release configuration having an elastic insulator provided with a plurality of longitudinal cavities each including a metallic retaining clip provided with inwardly bent tabs to engage the edges of a contact. Thus each time a lead is installed into a particular cavity the contact end thereon must be pressed through the gap between the tabs until engagement is made. Similarly, to extract the leads the customary practice is to advance a tubular tool until the spring tabs are spread. In each instance certain amounts of manipulative difficulty arises as result of the close fit between the lead insulation and the insulator plug. In the past tools like those described in the National Aerospace Standard 1664 have been used for such insertion and retraction, the tool being generally conformed as a plastic hollow structure split along one lateral surface. Alternatively, a plier assembly provided with split tubular end extensions has been utilized for this purpose like that described in Military Standard MS3483 (Navy).

The foregoing tools, while suited for their purpose, do not avail to the user all of the benefits of manipulative convenience. For example, the first tool is necessarily flexible since insertion of the lead must occur through flexible parting of the slit. The second tool is essentially conformed as a pair of pliers with the attendant requirement of a necessary grasp which renders manipulation more cumbersome.

As the pin density in the connector increases the manipulative difficulty to install each lead also increases. Thus a device which renders lead installation more convenient has been heretofore sought and it is a device of this kind that is disclosed herein.

SUMMARY OF THE INVENTION

Accordingly, it is the general purpose and object of the present invention to provide a contact installation tool for use with multi-pin connectors.

Other objects of the invention are to provide a contact installation tool conformed for manipulative convenience.

Yet further objects of the invention are to provide a contact installation tool which includes spring bias for closure thereof around the exterior of a lead.

Briefly, these and other objects are accomplished within the present invention by providing an installation tool generally conformed to include a handle terminating at the forward end thereof in a fixed lever projection which is attached to support a semi-circular first tubular segment extending in cantelever from the end thereof. A moveable slide extends into the handle to compress a spring on the interior thereof, said moveable slide emerging from the handle to extend along said fixed projection. This moveable slide is provided with a second cantelevered tubular segment aligned to abut the longitudinal edge of the first segment when released thus forming a tubular enclosure. To spread the segments, the slide is provided with a lever extending to the exterior of the handle by which one may manipulate the slide for inward retraction.

In an alternative form the lever for manipulating the slide may be provided with a detent thus allowing for the retention of the slide in either an open or a closed position. In this manner the gap between the two tubular segments may be expanded and fixed in this expanded state to receive the lead and upon the release of the detent the slide will translate by virtue of the spring towards the other tubular segment to enclose the lead. At this point the detent may be once again articulated to lock this enclosure freeing the hands of the user for the manipulative steps necessary to effect insertion or extraction.

BRIEF DESCRIPTION OF THE DRAWINGS

FIG. 1 is a side view, in partial section, of an inventive tool constructed according to the present invention;

FIG. 2 is a sectional detail taken along line 2—2 of FIG. 1;

FIG. 3 is yet another sectional detail illustrating the spread alignment of the structure shown in FIG. 2;

FIG. 4 is yet another sectional detail illustrating the inventive tool conformed for contact installation;

FIG. 5 is a detail view of a typical installation engagement of a lead in a connector;

FIG. 6 is a side view, in section, of an alternative tool end useful in contact extraction;

FIG. 7 is a sectional view of a connector assembly engaged by the inventive tool for contact withdrawal; and FIG. 8 is a side view, in section, of yet another embodiment of the inventive tool.

DESCRIPTION OF THE PREFERRED EMBODIMENTS

As shown in FIGS. 1–3 the inventive tool, generally designated by the numeral 10, comprises a handle 11 of substantially elongate, rectangular platform, provided with a groove 12 in one lateral face thereof. Groove 12 extends longitudinally in the side of the handle 11, in partial extension from a point adjacent the rear end thereof to an opening at the front. Received within this groove 12 and conformed for sliding fit therein is elongate slide 15. slide 15 emerges from the opening at the forward end of the groove in the handle 11 to terminate thereat in a slanted semicircular mount 17 conformed to receive an elongate semicircular tubular segment 16 shaped generally like a thin walled trough and aligned with the concave surface distal of the slide. The interior end of the slide 15, in turn, is opposed by a spring 18 compressed against the interior end of groove 12. To allow for manual articulation of the slide 15 and to limit the stroke thereof, handle 11 is provided with a transverse slot 19 communicating with the interior of the groove 12 through which a trigger post 21 extends. Trigger post 21, in turn, is attached to extend in cantelever from a lateral surface of the slide 15. Accordingly, the user by pressing on post 21 can articulate slide 15 against spring 18 through a stroke determined by the length of the slot 19.

To complete the structure a cover plate 25 is installed onto the lateral surface of handle 11 thus retaining slide 15 within the interior of groove 12. Cover plate 25 includes at the forward end thereof, an elongate projection 26 aligned adjacent mount 16 and extending in overlap thereof to form an opposing semicircular slanted seat 27 thereat. Received within seat 27 is yet another semicircular tubular segment 28 aligned to oppose the edges of segment 17 upon the outward progression of the slide. Segments 17 and 28 cooperate to form a circular guide conformed to receive on the interior thereof the insulator around any lead L. Thus the lead L may be inserted into the cavity formed by the cooperative alignment of segments 17 and 28 to pass therefrom over the forward edge of handle 11. In order to provide an opposing surface onto which the lead L may be laid, handle 11, at the forward end, is provided with a slanted arcuate surface 29 against which the lead is pressed during manipulation. To facilitate manual convenience the disposition of post 21 and the surface 29 are such that the user with his index finger on the post will be able to compress the lead for retention. Thus the user, with one hand, can both open the gap between segments 17 and 28 to receive the lead vary between and thereafter may compress the lead against surface 29 against translation. Since the lead is thus fixed against longitudinal motion within the confines of segments 17 and 18 manipulative convenience is achieved by which insertion and extraction may be accomplished.

More specifically, as shown in FIGS. 4–7, a typical multipin connector is provided with an elastomeric insulator block B including a plurality of connector bores or openings P into which various leads are inserted. Each lead L furthermore includes at the end thereof an expanded radius contact R conformed to be engaged by a retaining clip T received within the bore or opening P. Clip T, as is conventionally practiced in the art, is generally conformed as a tubular metallic segment which along one surface thereof and provided with inwardly directed tabs which oppose the outward extraction of the contact R. It is these tabs U that are displaced by the insertion of the structure formed by segments 28 and 17, allowing the spread of the clip or retainer T to withdraw the contact. In a similar manner the combined structure formed by segments 17 and 28 may be utilized for inserting the contacts by providing the necessary force transmitting structure to drive the contacts R past the inwardly directed tabs U. Thus the above-described features cooperate to form a tool which provides manipulative convenience to perform the foregoing steps of extraction or insertion. It is to be understood that similar to prior practice, the insertion ends of segments 17 and 28 may be modified to a tapered form I for installation and a straight form E for extraction.

The above structure may be further modified according to the illustration shown in FIG. 8. More specifically, as shown in this figure, an assembly 100, conformed for heavy duty use, is generally arranged similar to the description above and for that reason like parts thereof are similarly numbered with the prefix 1 appended thereto. One may therefore take reference to the above description or the general mode of cooperation between the various parts of it being undersood that the various geometric changes are primarily for the purpose of passing larger forces.

In this embodiment the trigger post 121 is arranged as a sliding assembly passing transversely across the slide 115. Post 121 is provided with a bias spring **121*a* conformed to purge the inward end thereof, into two recesses 121*b* and 121*c* formed in groove 112** along the travel of the slide. Thus the trigger post may be utilized to retain the jaws of the guide in either an open or a closed position thus rendering the hands of the user totally free for the manipulation sequence necessary in the course of installation. It is to be understood that in this implementation the lead may be laid on the face of the slide and the addition extension thus providing the necessary retention thereof when the need occurs.

Some of the many advantages of the foregoing invention should now be readily apparent. The invention provides a tool for which the complex manipulation often entailed in assembling a connector can be conveniently carried out. Furthermore the tool may be implemented for larger force manipulation which is particularly necessary when tight clearances are entailed.

Obviously many modifications and changes may be made to the foregoing description without departing from the spirit of the invention. It is therefore intended that the scope of the invention be determined solely on the claims appended hereto.

What is claimed is:

1. A tool for inserting and withdrawing electrical leads in the body of a multiple lead connector comprising:

an elongate handle of substantially rectangular form provided with a longitudinal groove in one lateral surface thereof, said groove communicating through one end of said handle and terminating in an urging surface proximate the other end of said handle, said handle including an arcuate opposing surface formed on one edge thereof proximate said one end and a slot transversely extending through the other edge into the interior of said groove;

a substantially rectangular slide received in said groove for longitudinal translation therein, said slide including an end extension projecting through said one end of said handle and having an arcuate seat at the end thereof;

a helical spring received between said slide and said urging surface of said groove for urging said slide to extend outwardly from said one end of said handle;

a post attached to said slide and aligned to extend through said slot for manual articulation of said slide along a longitudinal motion segment determined by the width of said slot;

an elongate plate attached to said handle in alignment over said groove for retaining said slide in the interior thereof, said plate including an end projection extending along said slide beyond said one end of said handle and having an arcuate end segment aligned in opposition to said seat;

a first and second tubular section respectively fixed to said arcuate end segment and to said arcuate seat to extend in cantelever therefrom, said first and second sections cooperating to form a tubular structure conformed to retain said electrical leads when opposed relative each other and to release said leads when separated, said tubular sections being aligned to guide said leads over said arcuate opposing surface to be compressed thereat by the fingers of a user of said tool; and detent means connected to said slide for fixing the sliding extension thereof in said opposing and separated alignments.

* * * * *